United States Patent [19]

Perratore et al.

[11] 4,237,960

[45] Dec. 9, 1980

[54] METHOD AND APPARATUS FOR REGULATING THE BATH LEVEL IN A CONTINUOUS CASTING MOLD

[75] Inventors: Albert J. Perratore, Queens Village; Mikhail Bass, Brooklyn, both of N.Y.

[73] Assignee: Concast Incorporated, Montvale, N.J.

[21] Appl. No.: 56,952

[22] Filed: Jul. 12, 1979

[51] Int. Cl.[3] ..... B22D 11/16

[52] U.S. Cl. ..... 164/4; 164/83; 164/416; 164/449; 73/290 R

[58] Field of Search ..... 164/83, 416, 4, 154–156, 164/449, 450; 73/304, 295, 290 R

[56] References Cited

U.S. PATENT DOCUMENTS 3,456,714 7/1969 Weiss ..... 164/154

*Primary Examiner*—Robert D. Baldwin
*Assistant Examiner*—K. Y. Lin
*Attorney, Agent, or Firm*—Tobias Lewenstein

[57] ABSTRACT

A detector for monitoring the bath level in an oscillatory continuous casting mold oscillates with the latter. The detector generates signals indicative of the bath level and a control unit interprets the signals and initiates adjustment of the bath level if this is outside of prescribed limits. Since the detector oscillates with the mold, and thus relative to the bath, the distance between the detector and the surface of the bath changes continuously even if the bath level remains constant. Inasmuch as the detector cannot distinguish between its own movement and that of the bath level, the oscillation of the detector results in the supply of misinformation to the control unit. In order to correct for the oscillation of the detector, a limit switch is connected with the detector or the control unit and is arranged to be closed by the oscillator at a predetermined point of its stroke. Thus, the detector will always be at the same position when the limit switch is closed. If the limit switch is connected with the detector, the latter is inoperative as long as the limit switch is open and monitors the bath level when the limit switch is closed. On the other hand, if the limit switch is connected with the control unit, the detector monitors the bath level continuously but the control unit accepts signals from the detector only when the limit switch is closed.

10 Claims, 1 Drawing Figure

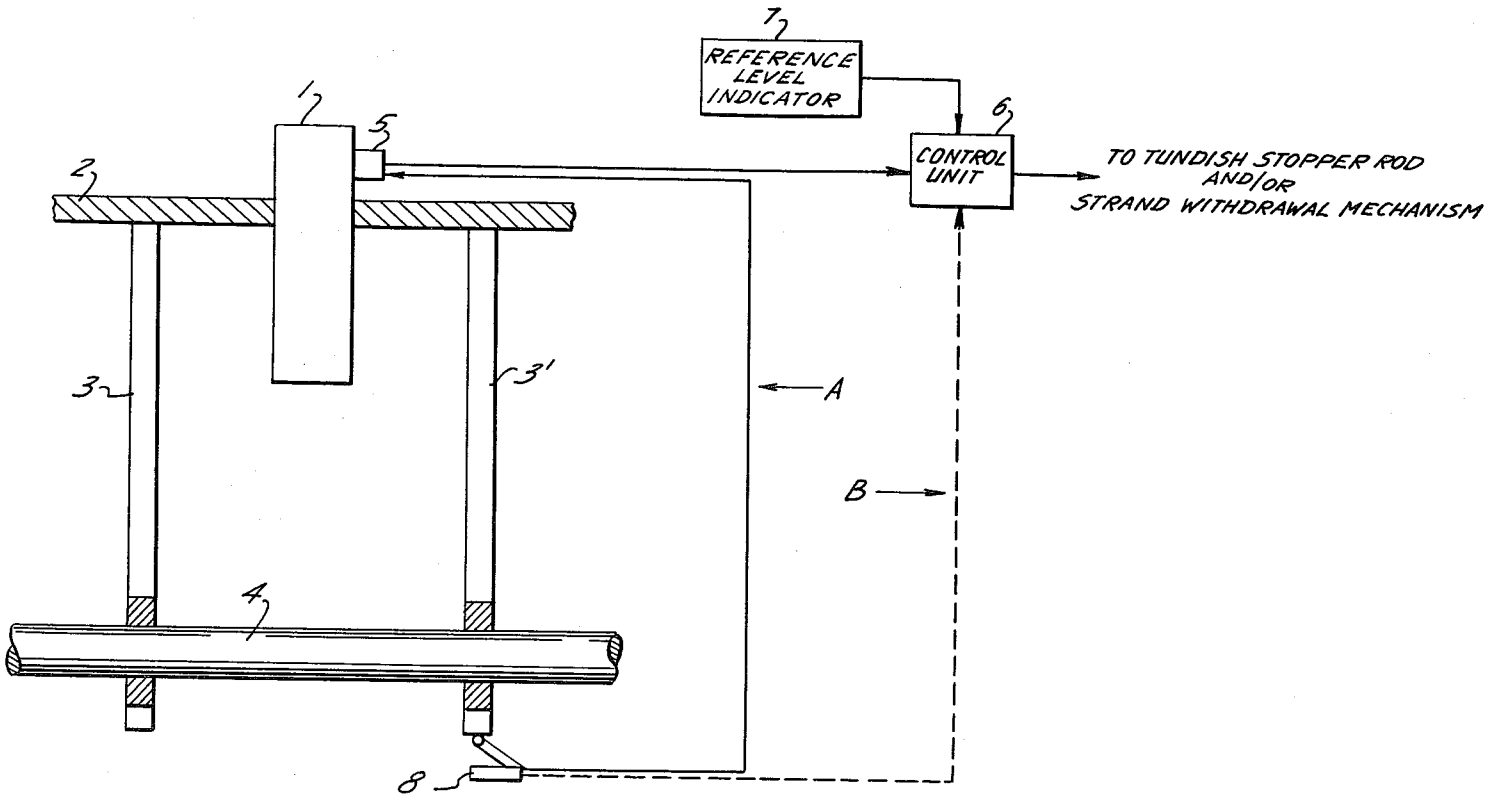
TO TUNDISH STOPPER ROD
AND/OR
STRAND WITHDRAWAL MECHANISM
CONTROL UNIT
REFERENCE LEVEL INDICATOR
A
B
1
2
3
3'
4
5
6
7
8

METHOD AND APPARATUS FOR REGULATING THE BATH LEVEL IN A CONTINUOUS CASTING MOLD

FIELD OF THE INVENTION

The invention relates generally to the continuous casting of metals, e.g. steel.

More particularly, the invention relates to the regulation of the bath level in a continuous casting mold.

BACKGROUND OF THE INVENTION

A conventional apparatus for the continuous casting of metals includes a cooled mold having a casting passage which extends in a generally vertical direction and which has open upper and lower ends. Molten metal is continuously introduced into the upper end of the casting passage from a tundish and forms a bath in the mold. The molten metal adjacent the walls of the casting passage solidifies to form a shell which surrounds the bath. A strand consisting of the shell and a molten core is continuously drawn out of the lower end of the casting passage via a strand withdrawal mechanism. The strand is sprayed with a cooling fluid, typically water, outside of the casting passage so as to progressively solidify its molten core.

During the withdrawal of the strand from the mold, the latter is oscillated parallel to the casting direction. This prevents the strand from sticking to the walls of the casting passage.

It is important to maintain the bath level in the mold within prescribed limits. If the bath level becomes too high, there is the danger of overflow. If the bath level becomes too low, the thickness of the shell upon leaving the mold will be less than that required to withstand the pressure generated by the molten metal within the shell.

The bath level may be controlled in several ways. It is possible to regulate the rate at which molten metal flows into the mold. This is normally achieved by providing the tundish with a stopper rod and manipulating the latter to increase or decrease the rate at which molten metal flows out of the tundish. Another possibility is to regulate the rate at which the strand is drawn out of the mold. This may be accomplished by controlling the speed of the strand withdrawal mechanism. It is further possible to regulate the inflow of molten metal into the mold as well as the withdrawal of the strand from the mold.

Since it is not always convenient to observe the bath level visually, detectors for monitoring the bath level without visual aid have been developed. One such detector includes a radioactive source and a receiver which are located on opposite sides of the mold. The radiation from the source travels to the receiver and the change in intensity of the radiation as it traverses the mold provides an indication of the bath level. Another such detector employs an induction unit which generates a primary electromagnetic field. The latter, in turn, induces currents in the mold walls which result in secondary electromagnetic fields. The magnitudes and directions of the secondary electromagnetic fields are indicative of the bath level.

A detector such as above may be connected with a control unit which interprets the signals received from the detector and controls the tundish stopper rod and/or the strand withdrawal mechanism accordingly.

The detector, which monitors the bath level continuously, is sometimes mounted on the mold since this places it in close proximity to the bath and thereby results in more reliable readings than would otherwise be the case. However, the detector then oscillates relative to the bath so that any two consecutive readings are taken at two different positions of the detector. Even if the bath level remains perfectly stationary, the detector then senses a change in bath level due to its own movement and initiates an adjustment via the control unit. This oscillation effect, which makes it difficult for the detector to distinguish between its own movement and a shift in the bath level, leads to unstable operation.

In order to overcome the oscillation effect, it has been suggested to incorporate a timer in the control unit. The timer causes the control unit to accept signals from the detector at predetermined time intervals only. Thus, although the detector is continuously monitoring the bath, the control unit receives signals only when the timer is activated. The timer may, for example, be set to operate once during each oscillation cycle. The timer is synchronized with the oscillator so that is is activated at the same instant during each oscillation cycle. For a constant oscillation rate, the detector will then always be at the same position when the signals therefrom are accepted by the control unit. Accordingly, the oscillation effect is eliminated.

The timer system works satisfactorily so long as the oscillation rate remains constant. However, since the timer cannot be reset during a casting operation, the same problem as previously arises when the oscillation rate must be changed during a casting operation due to changes in the casting conditions. The timer is then no longer synchronized with the oscillator so that the position of the detector is different whenever the timer is activated.

Another known system avoids this shortcoming of a timer. Here, a radioactive detector mounted on a generally vertical mold has a receiver which forms part of an electrical circuit. The radiation reaching the receiver generates a voltage which is proportional to the intensity of the radiation and which is continuously changing due to oscillation of the mold. The latter is oscillated by an arm having a roller which rides on top of a horizontal, eccentric shaft mounted for rotation. As the shaft rotates, the arm moves up and down thereby imparting an oscillatory movement to the mold. The arm is connected to the slide of a potentiometer which is in circuit with the receiver. By virtue of this connection, the arm produces a voltage which is dependent upon the position of the arm. The voltage due to the arm is in opposition to that generated by the radiation. These voltages are fed into a compensating unit which calculates the mean value thereof. This value, which is indicative of the bath level, is read on a dial or other instrument and may be used to control the tundish stopper rod and/or the strand withdrawal mechanism.

Instead of using a potentiometer as the voltage-generating unit for the arm, it is possible to use a magnetic arrangement consisting of an iron plate which moves between two poles in synchronism with the mold.

Although the latter system avoids the disadvantage of a timer outlined earlier, other problems arise with this system. To begin with, the voltage-generating unit for the arm must be relatively accurately zeroed if reliable compensation for the mold oscillation is to be achieved. This condition is difficult to maintain in a steel mill environment. Furthermore, the arm and its voltage-generating unit must be mechanically linked with one another. If looseness develops in the linkage, as is apt to occur, the compensation will no longer be reliable. Additionally, monitoring of the bath level and compensation for mold oscillation are performed continuously during a casting operation. Since the resulting voltages are fed into the compensating unit on a continuous basis, the compensating unit performs calculations continuously during each casting operation which affects its life adversely.

OBJECTS OF THE INVENTION

It is an object of the invention to provide a method and apparatus for the continuous casting of metals which make it possible to compensate for mold oscillation in a reliable manner.

Another object of the invention is to provide a simple method and apparatus for the continuous casting of metals which make it possible to compensate for mold oscillation regardless of the oscillation frequency.

SUMMARY OF THE INVENTION

The foregoing objects and others are achieved by the invention.

In accordance with the invention, the bath level in an oscillating continuous casting mold is monitored by a detector which oscillates with the mold. The detector generates signals indicative of the bath level and a control unit regulates this level in response to the signals. A limit switch is provided and has a first position in which the control unit receives signals from the detector. The limit switch further has a plurality of second positions in which the control unit receives no signals from the detector. The limit switch is directly or indirectly urged into its first position by the oscillator when the detector is at a predetermined position along its oscillation path, that is, the path traversed by the detector during each oscillation cycle.

Since, according to the invention, the control unit receives signals from the detector in dependence upon the position of the latter, the oscillation effect is eliminated even if the oscillation frequency changes. Furthermore, inasmuch as it is not necessary to mechanically link the oscillator and the limit switch in order to operate the latter, the problems associated with a mechanical linkage may be avoided. The need for accurate zero-point adjustments as in the compensating-voltage system of the prior art is also eliminated. Moreover, it becomes unnecessary to perform calculations on a continuous basis as in this system.

BRIEF DESCRIPTION OF THE DRAWING

The single FIGURE is a schematic, partly sectional view of a continuous casting apparatus equipped for bath level regulation in accordance with the invention.

DESCRIPTION OF THE PREFERRED EMBODIMENTS

The apparatus of the single FIGURE is of the type used for the continuous casting of metals, e.g. steel. Since such apparatus are known per se, only those details necessary for an understanding of the invention have been illustrated.

The apparatus includes a generally vertical continuous casting mold 1 which is mounted on a mold table 2. The mold table 2, in turn, is supported by an oscillator. The latter has arms 3 and 3' which ride on a rotatable, eccentric shaft 4 and carry the mold table 2. Rotation of the shaft 4 causes the arms 3 and 3', and hence the mold table 2 and the mold 1, to oscillate along the casting path which is generally vertical in the region of the mold 1.

In operation, a molten metal bath is formed in the mold 1 by teeming molten metal into the upper end thereof from a tundish located above the mold 1. The tundish is normally provided with a stopper rod to regulate the outflow of molten metal therefrom. When the bath reaches a predetermined or reference level in the mold 1, oscillation of the mold 1 is initiated and the withdrawal of a continuously cast strand from the lower end thereof is begun. The withdrawal is carried out by means of a suitably designed strand withdrawal mechanism.

Since too high or too low a level of the bath are undesirable, it is attempted to maintain the bath level within prescribed limits about the reference level in the mold 1. To this end, the apparatus of the FIGURE has an automatic control system for monitoring the bath level and correcting for excessive deviations thereof from the reference level.

The control system includes a detector 5 which monitors the bath level and generates signals indicative thereof. The detector 5 may take any conventional form but is preferably in the form of an electromagnetic induction device.

A control unit 6 is provided for interpreting the signals generated by the detector 5 and initiating the necessary corrective action if the bath level is outside of its prescribed limits. The control unit 6 determines whether or not the bath level is within its prescribed limits by comparing the signals received from the detector 5 with that received from a reference level indicator 7 which is programmed with the desired reference level for the bath. The control unit 6 corrects for excessive deviations of the bath level from the reference level by causing the outflow of molten metal from the tundish and/or the speed of the strand withdrawal mechanism to increase or decrease.

In order to provide the control unit 6 with signals which accurately reflect the bath level, the detector 5 is placed in close proximity to the bath. Preferably, the detector 5 is mounted directly on the mold 1 as shown. However, should this not be possible due to space limitations or for other reasons, the detector 5 may be mounted on the mold table 2. In either event, the result of placing the detector 5 in close proximity to the bath is that the detector 5 oscillates with the mold 1 and is thus subject to the oscillation effect.

In accordance with the invention, the oscillation effect is eliminated by incorporating a limit switch 8 in the bath level control system. The limit switch 8 may be connected with the detector 5 as in embodiment A drawn with a full line or with the control unit 6 as in embodiment B drawn with a dashed line.

The limit switch 8 is fixedly mounted below the arm 3' of the oscillator and is arranged to be closed by the arm 3' when the oscillator is at the bottom of its stroke. At all other positions of the oscillator, the limit switch 8 is open. Since the limit switch 8 is shifted to its closed position by the oscillator, it follows that the detector 5 will always be at the same position when the limit switch 8 closes.

In operation of embodiment A, the detector 5 is inoperative so long as the limit switch 8 is open. When the oscillator reaches the bottom of its stroke and the limit switch 8 closes, the detector 5 scans the bath and supplies signals indicative of the bath level to the control unit 6. The latter compares these signals with that obtained from the reference level indicator 7 and initiates corrective action if necessary. Since the control unit 6 receives signals from the detector 5 only when the limit switch 8 is closed, and the detector 5 always has the same position at this time, the oscillation effect is eliminated.

In operation of embodiment B, the detector 5 scans the bath continuously during a casting operation. However, the circuit between the detector 5 and the control unit 6 is open as long as the limit switch 8 remains open so that the signals generated by the detector 5 are not received by the control unit 6. When the oscillator reaches the bottom of its stroke and the limit switch 8 closes, the circuit between the detector 5 and the control unit 6 is completed. The control unit 6 now receives the signals generated by the detector 5 and, as before, uses these signals to initiate corrective action if necessary. The oscillation effect is again eliminated inasmuch as the control unit 6 receives signals from the detector 5 only when the limit switch 8 is closed and the detector 5 always has the same position at this time.

Although the limit switch 8 is shown as being closed by direct contact with the oscillator, it is possible to close the limit switch 8 with any part of the oscillating assembly comprising the oscillator, the mold table 2, the mold 1 and the detector 5. Furthermore, while it is convenient to arrange the limit switch 8 so that it closes when the oscillator is at the bottom of its stroke, the limit switch 8 may be closed at any other point of the stroke.

We claim:

1. A continuous casting apparatus for metals comprising:

(a) an oscillatory assembly including a continuous casting mold for accommodating a bath of molten metal, means for monitoring the level of the bath and for generating signals indicative of the bath level, and means for oscillating said mold and said monitoring means along the casting direction;

(b) means for regulating the bath level in response to the signals from said monitoring means; and (c) means for intermittently supplying signals from said monitoring means to said regulating means, said suppling means comprising a limit switch, and said limit switch having a first position in which said regulating means receives signals from said monitoring means, and a plurality of second positions in which said regulating means receives no signals from said monitoring means, said limit switch being urged into said first position by said assembly when the latter is at a predetermined position along the oscillation path thereof.

2. An apparatus as defined in claim 1, said monitoring means being continuously operative during a casting operation; and wherein said monitoring means and said regulating means are connected with one another when said limit switch is in said first position, and said monitoring means and said regulating means are disconnected from one another when said limit switch is in said second positions.

3. An apparatus as defined in claim 1, wherein said monitoring means is operative when said limit switch is in said first position, and said monitoring means is inoperative when said limit switch is in said second positions.

4. An apparatus as defined in claim 1, wherein said limit switch is arranged to be urged into said first position by said oscillating means when said assembly is at an end of said oscillation path.

5. An apparatus as defined in claim 1, wherein said monitoring means comprises a device for electromagnetic detection of the bath level.

6. A method of continuously casting metals comprising the steps of:

(a) oscillating a level monitoring source relative to a molten metal bath being continuously cast;

(b) monitoring the level of said bath with said source;

(c) generating signals indicative of said bath level with said source; and (d) regulating said bath level with said signals only when said source is at a first position along the oscillation path thereof but not when said source is at a plurality of second positions along said oscillation path, the regulating step being performed when said source is at said first position regardless of the oscillation frequency of said source.

7. A method as defined in claim 6, wherein the monitoring and generating steps are performed continuously and the regulating step is carried out using the signals generated when said source is in said first position.

8. A method as defined in claim 6, wherein the monitoring and generating steps are performed when said source is in said first position but not when said source is in said second positions.

9. A method as defined in claim 6, wherein said first position is at an end of said oscillation path.

10. A method as defined in claim 6, wherein the monitoring step is carried out electromagnetically.

* * * * *